US006530567B1

(12) United States Patent
Lang

(10) Patent No.: US 6,530,567 B1
(45) Date of Patent: Mar. 11, 2003

(54) CLAMPING METHOD AND SYSTEM FOR FIXING WORKPIECES

(76) Inventor: Günter Lang, Goethestrasse 40/1, D-73249 Wernau (DE)

( * ) Notice: Subject to any disclaimer, the term of this patent is extended or adjusted under 35 U.S.C. 154(b) by 0 days.

(21) Appl. No.: 09/673,126

(22) PCT Filed: Apr. 10, 1999

(86) PCT No.: PCT/DE99/01095

§ 371 (c)(1),
(2), (4) Date: Nov. 30, 2000

(87) PCT Pub. No.: WO99/52678

PCT Pub. Date: Oct. 21, 1999

(30) Foreign Application Priority Data

Apr. 11, 1998 (DE) ..... 198 16 328

(51) Int. Cl.[7] ..... B25B 1/24
(52) U.S. Cl. ..... 269/257; 269/270; 81/426.5
(58) Field of Search ..... 81/426.5; 269/257, 269/270, 282, 283

(56) References Cited

U.S. PATENT DOCUMENTS 3,930,329 A * 1/1976 Burkhardt ..... 43/4
4,251,066 A * 2/1981 Bowling ..... 269/283
4,928,938 A * 5/1990 Ross ..... 269/261
5,318,264 A * 6/1994 Meiste ..... 248/221.4
5,348,385 A * 9/1994 Berg ..... 312/247
5,551,676 A 9/1996 Ribreau
6,189,421 B1 * 2/2001 Futo et al. ..... 81/64
6,224,127 B1 * 5/2001 Hodge ..... 296/26.08
6,302,410 B1 * 10/2001 Wentworth ..... 279/152

FOREIGN PATENT DOCUMENTS

| | | |
|---|---|---|
| DE | 269 342 | 6/1989 |
| DE | 42 02 989 | 8/1993 |
| DE | 197 56 793 | 6/1999 |
| FR | 898 673 | 5/1945 |
| NL | 9 200 645 | 11/1993 |

OTHER PUBLICATIONS

Kibbe et al, "Unit 2, Work–Holding and Hand Tools", Machine Tool Practices, Third Edition, 1982, pp. 43,44,46.

* cited by examiner

*Primary Examiner*—Joseph J. Hail, III
*Assistant Examiner*—Daniel Shanley
(74) *Attorney, Agent, or Firm*—Venable, LLP; Norman N. Kunitz

(57) ABSTRACT

A clamping device for work piece(s) having at least one clamping surface and coupling elements on the clamping surface. The clamping device comprises a first clamping element having a contact surface and a plurality of form-fit elements and a second clamping element having a contact surface and a plurality of form-fit elements. The plurality of form-fit elements have a shape that complements that of the coupling elements. The distance between the contact surfaces are adjusted by a retaining device which is coupled to surfaces of the clamping elements.

20 Claims, 5 Drawing Sheets

CLAMPING METHOD AND SYSTEM FOR FIXING WORKPIECES

BACKGROUND OF THE INVENTION

1. Field of the Invention

The invention relates to a clamping device for workpieces that have been specially prepared for clamping in the clamping device, and a clamping method for workpieces.

2. Description of Prior Art

For machining in tool machines, the workpieces must be fixedly clamped and held at suitable clamping regions. The clamping setup must be designed such that, especially in machining processes in which material is removed from the workpieces, larger forces can also be readily diverted and therefore not cause a displacement of the workpiece. On the other hand, the workpiece should be as accessible as possible so that a wide range of machining processes can be performed on the workpiece in a single clamping setup. These two requirements are contradictory to some extent. If the workpiece is supposed to be accessible from, for example, five sides, a clamping that does not block access to the sides to be machined is required.

If workpieces are clamped between clamping jaws of a machine vise, for example, the two clamping jaws of the machine vise cover large areas of two oppositely-located sides of the workpiece. This impedes access to the workpiece.

SUMMARY OF THE INVENTION

In view of the above remarks, it is the object of the invention to provide a clamping device for workpieces, with which workpieces can be held securely, and which permits good access to the clamped workpieces.

This object is accomplished with the clamping device according to the present invention.

The clamping device has two clamping jaws or clamping elements, which are provided with form-fit elements whose embodiment is complementary to corresponding coupling elements of the workpiece. The coupling elements are embodied on the workpiece in a preparatory work step. They usually perform no other function than to serve in clamping the relevant workpiece in the clamping device of the invention. The form-fit elements of this device permit the workpiece to be fixed in, for example, an extremely narrow, strip-shaped region. The workpiece clamped in a frictional connection between the clamping elements is held by the form-fit elements and the coupling elements in an additional form-fit. It is therefore possible to clamp workpieces that project relatively far out of the space defined between the two clamping elements. Hence, machining processes that involve material removal, or other machining processes that exert considerable forces on both the side surfaces and the end face of the workpiece, can be performed on the workpiece, with the only limitation being the inherent elasticity of the workpiece. The workpiece is seated with only one very short base region between the two clamping elements, with the form-fit elements preventing the workpiece from being tipped out of the clamping jaws under the exertion of large forces. The form-fit elements are embodied to prevent or block any movement of the workpiece in any direction oriented parallel to the contact surfaces of the clamping elements. The provision of both clamping elements with corresponding form-fit elements prevents any rotational, pivoting or tipping movement of the workpiece.

The form-fit elements transmit the corresponding retaining forces to the clamping elements, and divert them, regardless of whether the two clamping elements can be adjusted toward and away from one another, or only one of the two clamping elements is mobile. If the clamping elements are pressed against the workpiece so as to clamp it between themselves, the form-fit elements automatically engage the coupling elements and stop the workpiece.

In addition to the combination form-fit and frictional-lockup clamping or holding of the workpiece in the clamping device, the form-fit offers the advantage that the workpiece assumes a defined position relative to the clamping device from the outset. Erroneous positioning can be virtually precluded. Consequently, setting up the workpieces may require far less effort.

The form-fit elements, which can be embodied, for example, as projections or depressions on or in the clamping elements, are preferably integral to the clamping elements. This assures a high load-bearing capacity. Accordingly, the coupling elements of the workpiece are depressions or projections that are imprinted into or mounted onto the workpiece in a machining step prior to the clamping process. For example, the work step can be a stamping machining process in which the clamping region of the workpiece is slightly plastically deformed. This deformation is preferably effected in a region of the workpiece that is not impeded in function by the stamping of depressions or the mounting of projections. Particularly in workpieces in which such regions are absent, the coupling elements can also be discarded following the machining process. This is possible in, for example, a grinding or milling machining process that is performed in a different, possibly conventional, clamping setup.

The form-fit elements and coupling elements can be embodied in the manner of a toothing, for example. The individual teeth and the associated depressions are respectively equidistantly spaced. To assure a fixed clamping position, however, it is also possible to modify the distribution at a predetermined location, or omit an individual tooth or an individual depression.

The truncated-pyramid shape has proven advantageous for the form-fit elements and coupling elements. The frustoconical shape is also possible. In both cases, the form-fit elements engage the associated coupling elements relatively easily, especially if the flank angle of the form-fit elements is not too large. For example, it has proven advantageous for the angle formed by the side surfaces of the truncated-pyramidal projections and the contact surface to be no larger than 45°. The associated depressions serving as coupling elements can be stamped easily; while they are not very deep, they assure a good form-fit coupling between the workpiece and the clamping jaws.

The form-fit elements are disposed, for example, in a single, straight row on one edge of the clamping jaw. This permits a particularly compact, space-saving clamping of workpieces. Other arrangements are, however, likewise conceivable and plausible. If very large forces are to be absorbed, patterns consisting of, for example, two or more rows can be used.

If the form-fit elements and the coupling elements are identical in size, or even have some play relative to one another, a true separation of function between the contact surface and the form-fit element is effected: The contact surfaces serve in the frictional-lockup clamping, while the form-fit elements assume the function of fixing and securing the position of the workpieces during machining. The advantage of this embodiment is that the form-fit and coupling elements are not subjected to stress during the clamping; no stressing occurs until the machining process. If, however, the desired clamping is to permit effective suppression of even slight movements of the workpiece, it can be advantageous for the elements embodied as projections to be at least slightly larger than the associated elements embodied as depressions. The form-fit elements on the clamping elements are preferably dimensioned to be larger or smaller than specified, and the material of the clamping elements is preferably selected to limit the occurrence of plastic deformations of the workpiece, if they occur at all. Such clamping elements permit a long-term precise, reliable clamping of workpieces.

BRIEF DESCRIPTION OF THE DRAWINGS

The drawing illustrates embodiments of the invention. Shown are in.

DETAILED DESCRIPTION OF THE INVENTION

Figure 1:
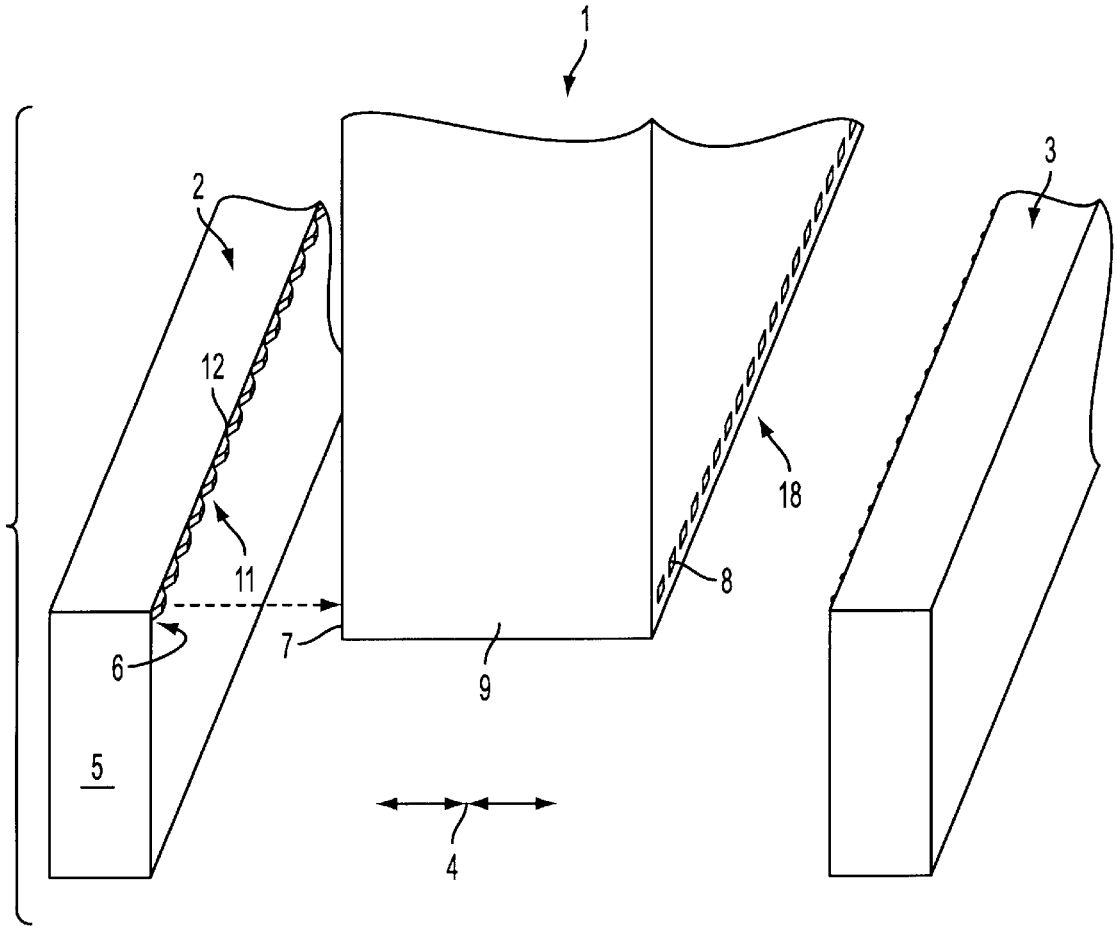
FIG. 1 the clamping system according to the invention in a cutout, schematic and perspective representation.

FIG. 1 illustrates a workpiece 1, which can be fixedly clamped by two clamping jaws 2, 3 in a tool machine, not shown in detail. The clamping jaws 2, 3 are held on an adjusting device, not shown in detail, so as to be adjusted toward and away from one another in the direction of the arrow 4 in FIG. 1. The adjusting device is designed to exert a force on the clamping jaws 2, 3 that moves the jaws 2, 3 toward one another as needed.

The clamping jaws 2, 3 shown in FIG. 1 are disposed in mirror symmetry. The following description of the clamping jaw 2 also applies to the clamping jaw 3.

The clamping jaw 2 has, for example, a parallelepiped base body 5, which is provided with a planar face 6 on its side facing the workpiece 1. The planar face 6 serves as a contact surface for a clamping surface 7, which is provided at the workpiece 1 and is likewise planar; in FIG. 1, this surface is hidden due to the perspective representation. On the opposite side, the workpiece 1 has a corresponding planar surface 8, which faces the clamping jaw 3, is mirror-symmetrical with respect to the planar surface 7, and is visible due to the perspective representation in FIG. 1. This surface will be described below instead of the clamping surface 7.

Figure 2:
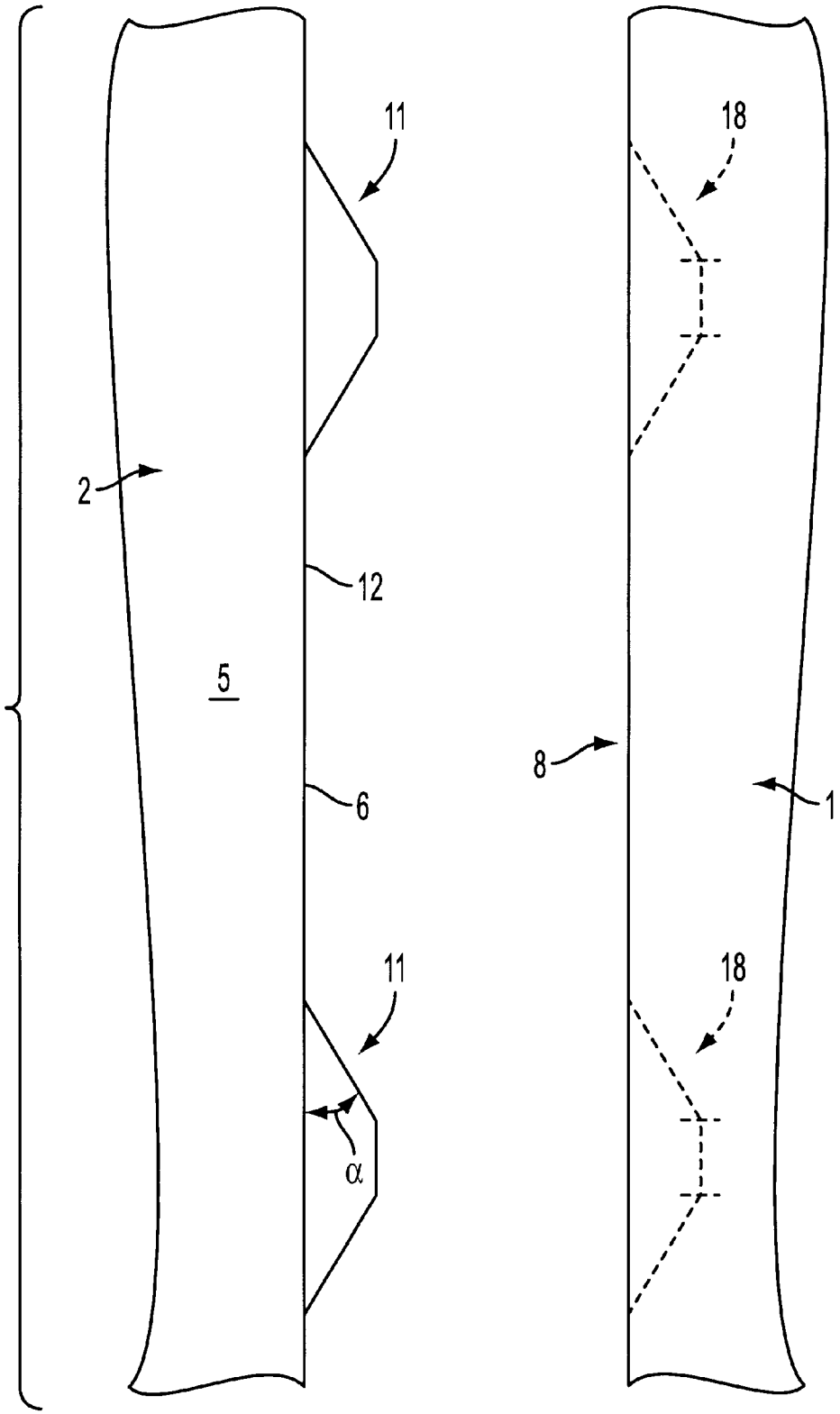
FIG. 2 the clamping system according to FIG. 1, in a schematic, cutout plan view.
Figure 3:
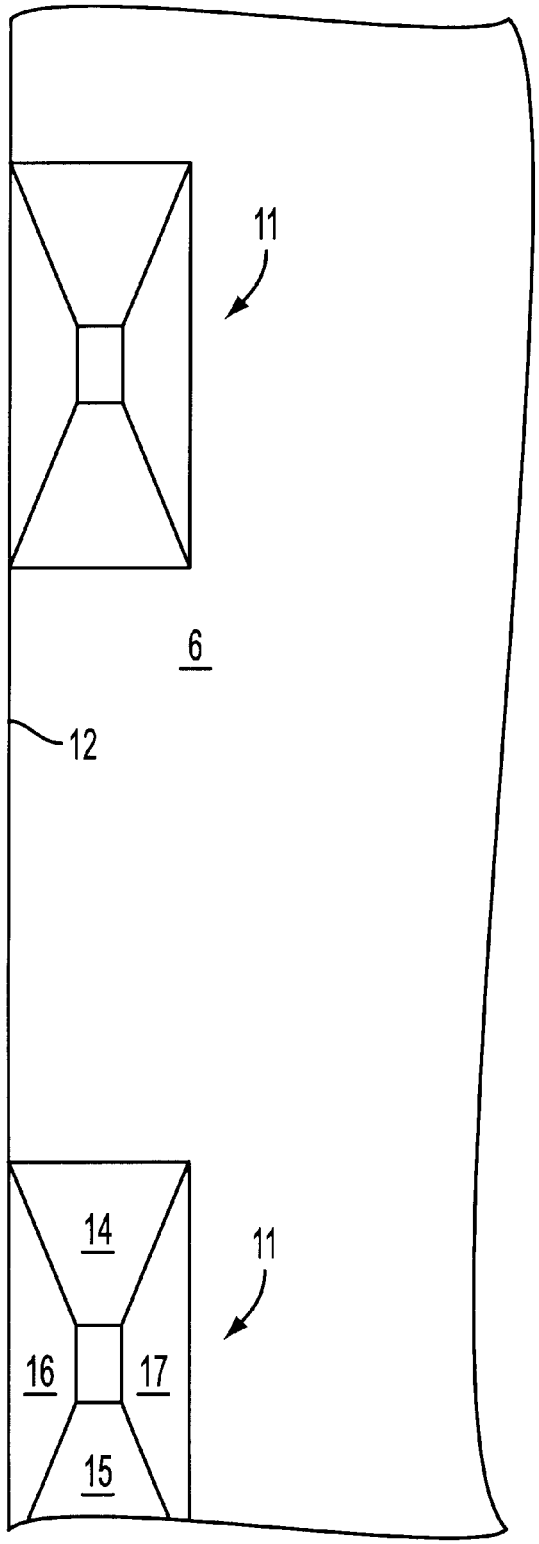
FIG. 3 a clamping element for the clamping system according to FIGS. 1 and 2, in a simplified frontal, cutout view.

The clamping jaws 2 and 3 serve to grasp the workpiece 1 only in the immediate vicinity of its lower edge 9. If necessary, however, they can also grasp other locations. For this purpose, a plurality of projections 11 serving as form-fit elements is disposed in a row on the contact surface 6. The projections 11, which are identical to one another, extend along an upper edge 12 of the clamping jaw 2. The same applies for the clamping jaw 3. FIG. 2 illustrates a cutout of the clamping jaw 2 on a different scale. As can be seen particularly in connection with FIG. 3, the projections 11 have a truncated-pyramid shape. They are respective integral components of the base body 5. As can be seen from FIGS. 2 and 3, their spacing from one another is preferably greater than their expansion in the direction of the edge 12.

The truncated-pyramidal projections 11 are oblong in the direction of the edge 12, i.e., they have a rectangular base surface. In principle, the shape can differ from the aforementioned ones, but the illustrated truncated-pyramid shape with the rectangular base yields a good force transmission with a minimal space requirement. The angle of slope $\alpha$, that is, the respective angle formed by each side surface 14, 15, 16, 17 with the contact surface 6, is preferably relatively flat. The angles of slope of the side surfaces 14, 15 bordering the narrower edges of the base surface are preferably smaller than 45°. The height of each pyramid-like projection 11 is preferably no greater than the length of the narrower edge of the base surface.

The workpiece 1 is provided with recesses 18, which are respectively associated with the projections 11 and are shaped to correspond to them. The recesses 18 are produced, for example, in a stamping process, and their embodiment is complementary to that of the projections 11 serving as form-fit elements. In the present case, the recesses 18 are truncated-pyramidal depressions.

The clamping of workpieces 1 involves the following steps:

Prior to clamping, the clamping surfaces 8 of the workpiece 1 are prepared for clamping. To this end, the workpiece is inserted into a stamping device, and adjusted if the recesses 18 are intended to be at precisely specified locations. This is necessary particularly if the workpiece 1 is to be machined without further adjustments after being clamped in the clamping jaws 2, 3. In other cases, in which the clamped workpiece 1 is to be sampled or otherwise measured in order to determine its actual position, an adjustment in the stamping device can also be omitted.

In the stamping device, a press die stamps the row of recesses 18 visible in FIG. 1. This can be effected with a flat die moving in linear fashion, thereby stamping all of the recesses 18 simultaneously, or with a die that only creates one recess 18 at a time. Once this die has stamped a recess 18, it is moved further by one position, thus creating all of the recesses 18 successively.

It is also possible to stamp the recesses 18 with a roller that has projections and is guided across the clamping surface 8.

Once the projections 18 are formed, the tool is guided between the clamping jaws 2, 3, after which the jaws are moved toward one another in the direction of the arrow 4 until the projections 11 extend into the recesses 18 and the contact surfaces 6 are pressed tightly against the clamping surfaces 7, 8. The projections 11 are seated, without play, in the recesses 18, and hold the workpiece 1 in a form-fit in case the forces to be absorbed are greater than the static friction between the contact surfaces 6 and the clamping surfaces 7, 8. The support offered by the frictional lockup prevents any play and deviations in position, which can in turn prevent the workpiece 1 from vibrating during machining. The form-fit of the projections 11 and the recesses 18, on the other hand, prevents the workpiece 1 from being forced out of the clamping jaws 2, 3.

Figure 4:
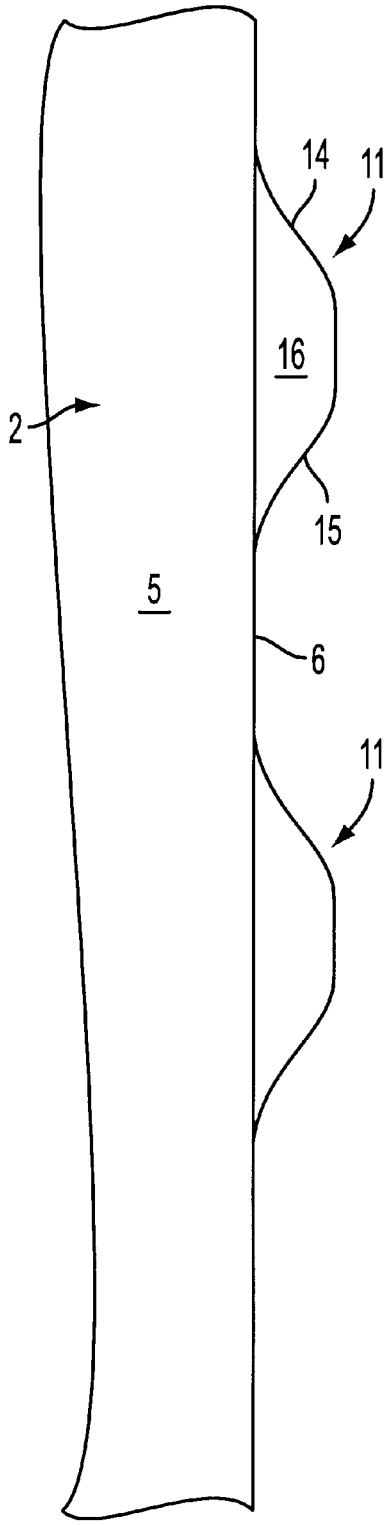
FIG. 4 a clamping element that is a component of the clamping system according to FIGS. 1 through 3, with modified form-fit elements, in a schematic plan view.

The above-described projections 11 serving as form-fit elements have straight edges. As is shown in FIG. 4, however, it is also possible for the edges 14, 15, 16, 17 of each frustoconical projection 11 to be arched, particularly with respect to the recesses 18, which are advantageously imprinted in the workpiece in the stamping process, and are therefore not limited to a sharp-edged embodiment. With a suitable arching of the edges, each projection 11 can rest with virtually its entire surface in the associated projection 18. This serves in assuring the force transmission, and thus maximizing the transmittable forces. The arching and curvature of the projections 11 is adapted to the surface courses embodied on the workpiece during the stamping process. It is also possible here to provide the projections 11 with a more or less large over-dimensioning so that the projections are seated in the recesses 18 with a prestress. The flat angles of slope of the projections 11 prevent the workpiece 1 from becoming wedged with the clamping jaws 2 and 3.

Figure 5:
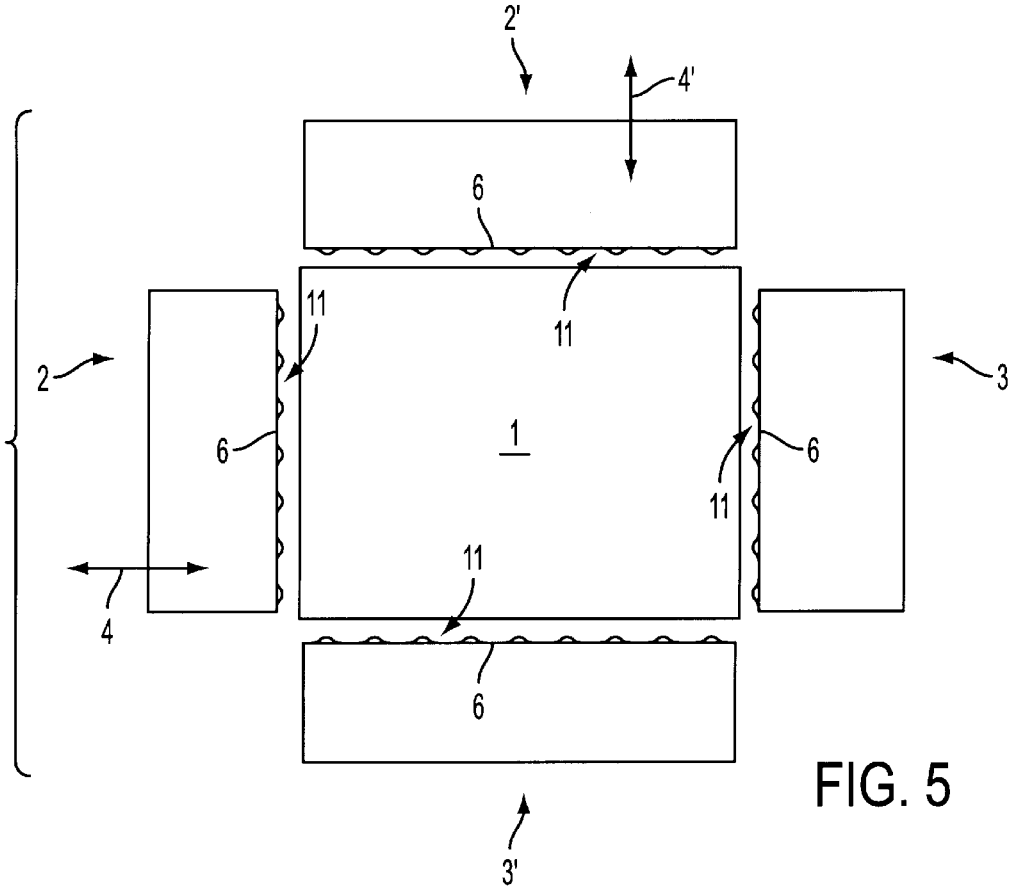
FIG. 5 a modified embodiment of a clamping system having a plurality of clamping elements provided with form-fit elements, in a schematic plan view.

The above-described clamping system involved two clamping jaws 2, 3. As illustrated in FIG. 5, more jaws, for example four jaws 2, 3, 2', 3' arranged opposite one another in pairs, can also be provided. The clamping jaws 2, 3, 2', 3' are embodied to correspond to the above-described clamping jaws, and have respective projections 11, which extend into correspondingly prepared recesses of the workpiece 1. At least two of the clamping jaws 2, 3, 2', 3' are disposed to be displaced by means of a force-actuated adjusting device, as indicated by the arrows 4, 4'.

Figure 6:
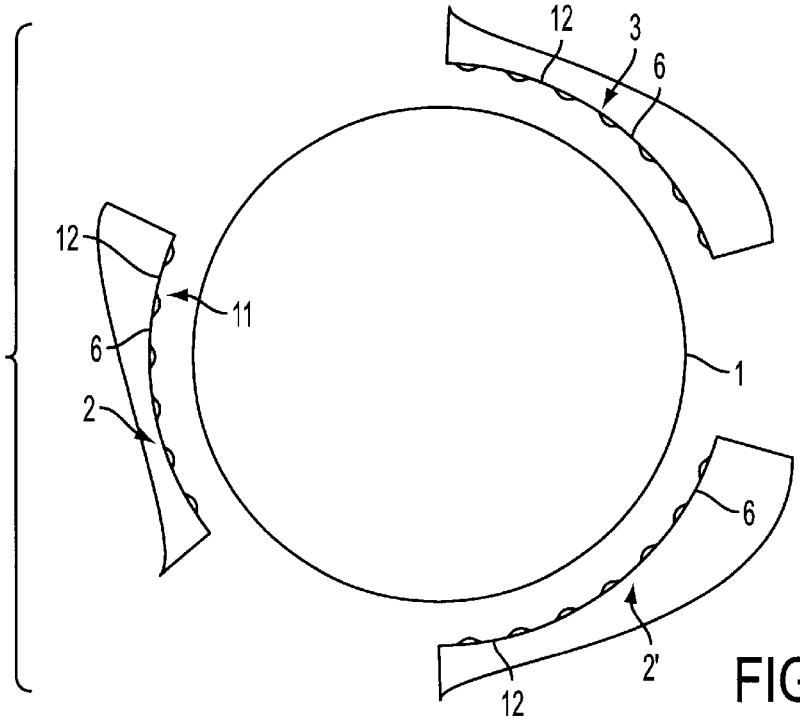
FIG. 6 a further embodiment of a clamping system having clamping elements, which are provided with form-fit elements, in a schematic plan view.

Whereas, in the above-described embodiments, the clamping jaws 2, 3 each have planar contact surfaces 6, these surfaces can also be arched, for example in cylindrical fashion, as in the embodiment according to FIG. 6. The illustrated clamping jaws 2, 3, 2' serve to clamp a cylindrical workpiece 1, with each clamping jaw 2, 2', 3 having a cylindrically-arched contact surface 6, whose curvature is determined by the radius of curvature of the cylindrical workpiece 1. Each clamping jaw is, again, equipped with projections 11, which are disposed along an edge 12 of each clamping jaw 2, 2', 3. A clamping device of this type permits workpieces 1 to be clamped briefly in lathes and friction-welding machines, and in similar applications. The advantage here is that only a very short axial region of the workpiece must be clamped. If a larger region is available, and workpieces 1 having varying diameters are to be clamped, the projections 4 can also be disposed in the axial direction, unlike in the illustrated embodiment, in which case only the narrow, strip-shaped contact surfaces of the clamping edges of the clamping jaws are provided with projections 11.

If necessary, the form-fit elements on the clamping jaws 2, 3 can also be formed by recesses. In this case, the workpiece 1 must be provided with corresponding, complementary projections in the preparatory work step. The advantage of this embodiment and procedure is that the projections on the workpiece 1 that are required for clamping can easily be removed after machining.

A clamping system that encompasses two or more clamping jaws is provided for clamping workpieces 1. The clamping jaws are provided with form-fit elements, e.g., projections 11, which are disposed at regular intervals and project from corresponding contact surfaces 6. Complementary recesses 18, which serve as coupling elements, are embodied in the workpiece in a preparatory step, which may involve stamping. The clamping system effects a combined frictional-lockup and form-fitting clamping of the workpiece 1 that permits the transmission of large retaining forces with a small surface requirement with respect to the workpiece and the clamping elements 2, 3.

What is claimed is:

1. A clamping device for workpiece having at least one clamping surface and coupling elements disposed on the clamping surface, comprising:

a first clamping element having a contact surface and a plurality of form-fit elements, said plurality of form-fit elements having an embodiment that complements that of the coupling elements of the workpiece and being disposed at regular intervals on the contact surface;

a second clamping element having a contact surface and a plurality of form-fit elements, said plurality of form-fit elements having an embodiment that complements that of the coupling elements of the workpiece and being disposed at regular intervals on the contact surface;

a third clamping element having a contact surface with form-fit elements; and a retaining device to which the clamping elements are secured, said retaining device adjusting the distances between the contact surfaces.

2. The clamping device according to claim 1, wherein the first clamping element is mobile, and the second clamping element is stationary.

3. The clamping device according to claim 1, wherein the clamping elements are adjustable.

4. The clamping device according to claim 1, wherein the contact surfaces are planar.

5. The clamping device according to claim 1, wherein the contact surfaces are arched.

6. A clamping device for workpiece having at least one clamping surface and coupling elements disposed on the clamping surface, comprising:

a first clamping element having a contact surface and a plurality of form-fit elements, said plurality of form-fit elements having an embodiment that complements that of the coupling elements of the workpiece and being disposed at regular intervals on the contact surface;

a second clamping element having a contact surface and a plurality of form-fit elements, said plurality of form-fit elements having an embodiment that complements that of the coupling elements of the workpiece and being disposed at regular intervals on the contact surface;

a retaining device to which the clamping elements are secured, said retaining device adjusting the distance between the contact surfaces; and wherein, the form-fit elements are formed by a toothing provided on the contact surface.

7. The clamping device according to claim 1, wherein the form-fit elements are formed by concave or convex surface regions.

8. The clamping device according to claim 1, wherein the form-fit elements are projections or depressions disposed on the contact surface.

9. The clamping device according to claim 8, wherein the projections or depressions are identical to one another.

10. The clamping device according to claim 8, wherein each projection or depression has a truncated-pyramid shape.

11. The clamping device according to claim 8, wherein each projection or depression has a frustoconical shape.

12. The clamping device according to claim 8, wherein adjacent projections or depressions are equidistantly spaced from one another.

13. The clamping device according to claim 1, wherein all of the form-fit elements are disposed in a straight row.

14. The clamping device according to claim 1, wherein the form-fit elements are disposed in the immediate vicinity of an edge of the contact surface.

15. The clamping device according to claim 1, wherein the form-fit elements and the coupling elements are identical in size.

16. The clamping device according to claim 7, wherein, if the form-fit elements are convex, they are larger than the coupling elements, and if the form-fit elements are concave, they are smaller than the coupling elements.

17. The clamping device according to claim 6, wherein the form-fit elements are projections that are equidistantly spaced from one another and disposed on the contact surface in a straight row.

18. The clamping device according to claim 6, wherein the form-fit elements are disposed in the immediate vicinity of an edge of the contact surface.

19. The clamping device according to claim 6, wherein the form-fit elements are projections, each of said projections having a truncated-pyramid shape.

20. The clamping device according to claim 6, wherein the form-fit elements are projections, each of said projections having a frustoconical shape.

* * * * *